US005469672A

United States Patent [19]

Fisher

[11] Patent Number: 5,469,672

[45] Date of Patent: Nov. 28, 1995

[54] AWNING FLASH STRIP

[76] Inventor: Larry M. Fisher, 2316 Piedmont Ridge Ct., Marietta, Ga. 30062

[21] Appl. No.: 204,000

[22] Filed: Mar. 1, 1994

[51] Int. Cl.[6] ..... E04B 1/34

[52] U.S. Cl. ..... 52/74; 52/202; 52/716.1; 52/717.03

[58] Field of Search ..... 51/63, 74, 222, 51/466, 202, 716.1, 716.2, 716.3, 716.4, 716.8, 718.01, 717.03; 160/46, 56, 76, 83.1, 391, 392, 395; 24/462, 460, 461

[56] References Cited

U.S. PATENT DOCUMENTS

| | | | |
|---|---|---|---|
| D. 218,295 | 8/1970 | MacLellan et al. | D13/6 |
| D. 309,351 | 7/1990 | Patsy, Jr. | D25/119 |
| 2,287,667 | 6/1942 | Brown | 156/15 |
| 3,508,369 | 4/1970 | Tennison | 52/396 |
| 4,189,880 | 2/1980 | Ballin | 52/202 |
| 4,193,235 | 3/1980 | Cucchiara | 52/202 |
| 4,231,141 | 11/1980 | Derrick et al. | 24/243 |
| 4,233,790 | 11/1980 | Meadows | 52/222 |
| 4,759,087 | 6/1988 | Zeilinger | 24/462 X |
| 4,817,655 | 4/1989 | Brooks | 135/101 |
| 4,926,605 | 5/1990 | Milliken et al. | 52/63 |
| 5,044,131 | 9/1991 | Fisher | 52/63 |
| 5,209,029 | 5/1993 | Foerst | 52/74 X |
| 5,224,306 | 7/1993 | Cramer | 52/63 |
| 5,237,785 | 8/1993 | Lukes | 160/392 X |

*Primary Examiner*—Carl D. Friedman
*Assistant Examiner*—Kien T. Nguyen
*Attorney, Agent, or Firm*—Louis T. Isaf; James A. Witherspoon

[57] ABSTRACT

Provided is a flexible, water impervious flash strip for forming a substantially permanent watertight seal between an awning assembly and the building structure to which the awning assembly is attached. The flash strip includes a lip protrusion extending from the rear of the flash strip and biased to extend rearward and slightly upward from the flash strip, a leg protrusion depending from the rear of the flash strip, and a tab protrusion depending from the bottom of the flash strip between the front and rear of the flash strip. The tab protrusion is mated to the elongated stapling channel of a framing tube that is at the upper edge of the awning assembly and that is to be attached to the wall of the building. The flash strip is oriented so that as the framing tube is drawn toward and secured to the wall of the building, the leg protrusion of the flash strip is sandwiched between the framing tube and the wall of the building, and the lip protrusion engages the wall and automatically deforms while sliding slightly up the wall to define a secure seal between the flash strip and the wall. The flash strip diverts water flowing down the wall of the building across the flash strip and onto the cover of the awning to substantially preclude the flow of water between the awning and the building.

22 Claims, 5 Drawing Sheets

AWNING FLASH STRIP

BACKGROUND OF THE INVENTION

The present invention relates generally to the field of awnings and more particularly to the field of attaching an awning to a building, or some other suitable structure, in a watertight manner.

Awning assemblies are considered well-known. One type of awning assembly comprises an awning frame to which an awning cover is attached. The awning cover is attached directly to the awning frame by clips or staples. The awning frames are constructed from elongated framing tubes that define elongated stapling channels. The framing tubes are interconnected to define the awning frame. The fabric cover is often constructed from pieces of fabric, such as polyester or acrylic, that are extended between and stapled into the stapling channels of the framing tubes. Once fabric is stapled into a stapling channel, it is common for a PVC bead to be driven into the stapling channel. Once an awning assembly is constructed, it is often attached to the exterior wall of a building by attaching one of the framing tubes at the upper-most edge of the awning assembly to the wall of the building. Often framing tubes at the lower edge and framing tubes between the upper and lower edges are also attached to the exterior wall of the building.

Awnings function as decoration. Awnings also often function as shelters from the weather. Thus, it is often desirable or necessary to caulk between an awning and the wall to which it is connected in an effort to preclude the flow of water between the awning and the wall. Caulking is typically carried out by spreading uncured caulking material, such as silicon, at the interface between the awning assembly and the building, and allowing the caulking material to cure. Such caulking has its disadvantages.

The disadvantages of caulking include the fact that caulking typically provides only a temporary watertight seal. To maintain a watertight seal with caulking it is often necessary to reapply the caulking on a regular basis. This is, of course, time consuming and therefore expensive. Furthermore, caulking can be messy and difficult to apply. Additionally, many awnings are positioned such that they are difficult to reach, whereby caulking them can be dangerous.

There is, therefore, a need in the industry for a product that solves these and other related, and unrelated, problems.

SUMMARY OF THE INVENTION

Briefly described, the present invention comprises a watertight awning assembly. The invention includes a flexible, water impervious flash strip for forming a substantially permanent watertight seal between an awning assembly and the building structure to which the awning assembly is attached. In accordance with the preferred embodiment of the present invention, the flash strip connects to and becomes part of the awning assembly such that when the awning assembly is attached to the building, the flash strip is automatically sandwiched between and oriented relative to the awning assembly and the building structure to form a substantially watertight barrier therebetween. Additionally, the flash strip is preferably attached to an awning assembly when the awning assembly is being fabricated. The fabrication is preferably carried out remotely from the building to which the awning assembly is to be attached, whereby job-site weatherproofing work is minimized.

In accordance with the preferred embodiment of the present invention, the flash strip is formed from a single extruded piece of a suitable flexible plastic material and includes a top, a bottom, a front end, and a rear end. In accordance with the preferred embodiment of the present invention, the flash strip includes a lip protrusion extending generally from the rear end of the flash strip and biased to extend rearward and slightly upward from the flash strip, a leg protrusion depending from the rear end of the flash strip, and a tab protrusion extending from the bottom of the flash strip between the front and rear ends of the flash strip. In accordance with the preferred embodiment of the present invention, the flash strip is mated to the framing tube that is at the upper edge of the awning assembly and that is to be attached to the wall of the building. The framing tube defines an elongated stapling channel into which the fabric cover of the awning is stapled and into which the tab protrusion of the flash strip inserts to secure the flash strip to the framing tube. The flash strip is preferably constructed and arranged to cover the stapling channel and preclude the flow of any moisture thereinto. The flash strip is, in accordance with the preferred embodiment, constructed and connected to the flaming tube such that, as the framing tube is drawn toward and secured to the wall of the building, the leg protrusion of the flash strip is sandwiched between the framing tube and the wall of the building, and the lip protrusion engages the wall and automatically deforms while sliding slightly up the wall to define a secure seal between the flash strip and the wall. The flash strip defines a unique shape that diverts any water flowing down the wall of the building across the flash strip, over the stapling channel, and onto the fabric cover of the awning assembly, thereby precluding the flow of water between the awning and the wall of the building.

It is therefore an object of the present invention to provide and maintain a watertight seal between an awning assembly and the building structure to which the awning assembly is attached.

Another object of the present invention is to simplify the process of maintaining a watertight seal between an awning assembly and the building structure to which the awning assembly is attached.

Yet another object of the present invention is to provide a flash strip that uniquely connects to the stapling channel of an elongated tube from which an awning frame is constructed.

Still another object of the present invention is to provide a component that complements and readily cooperates with existing awning components.

Still another object of the present invention is to provide a color coordinated awning assembly.

Still another object of the present invention is to provide a flash strip that not only functions to maintain a watertight seal between an awning assembly and the building structure to which the awning assembly is attached, but that further functions to color coordinate with the cover of the awning assembly.

Still another object of the present invention is to minimize job-site weatherproofing work.

Other objects, features and advantages of the present invention will become apparent upon reading and understanding this specification, taken in conjunction with the accompanying drawings.

DETAILED DESCRIPTION OF THE PREFERRED EMBODIMENT

Figures 1, 2:
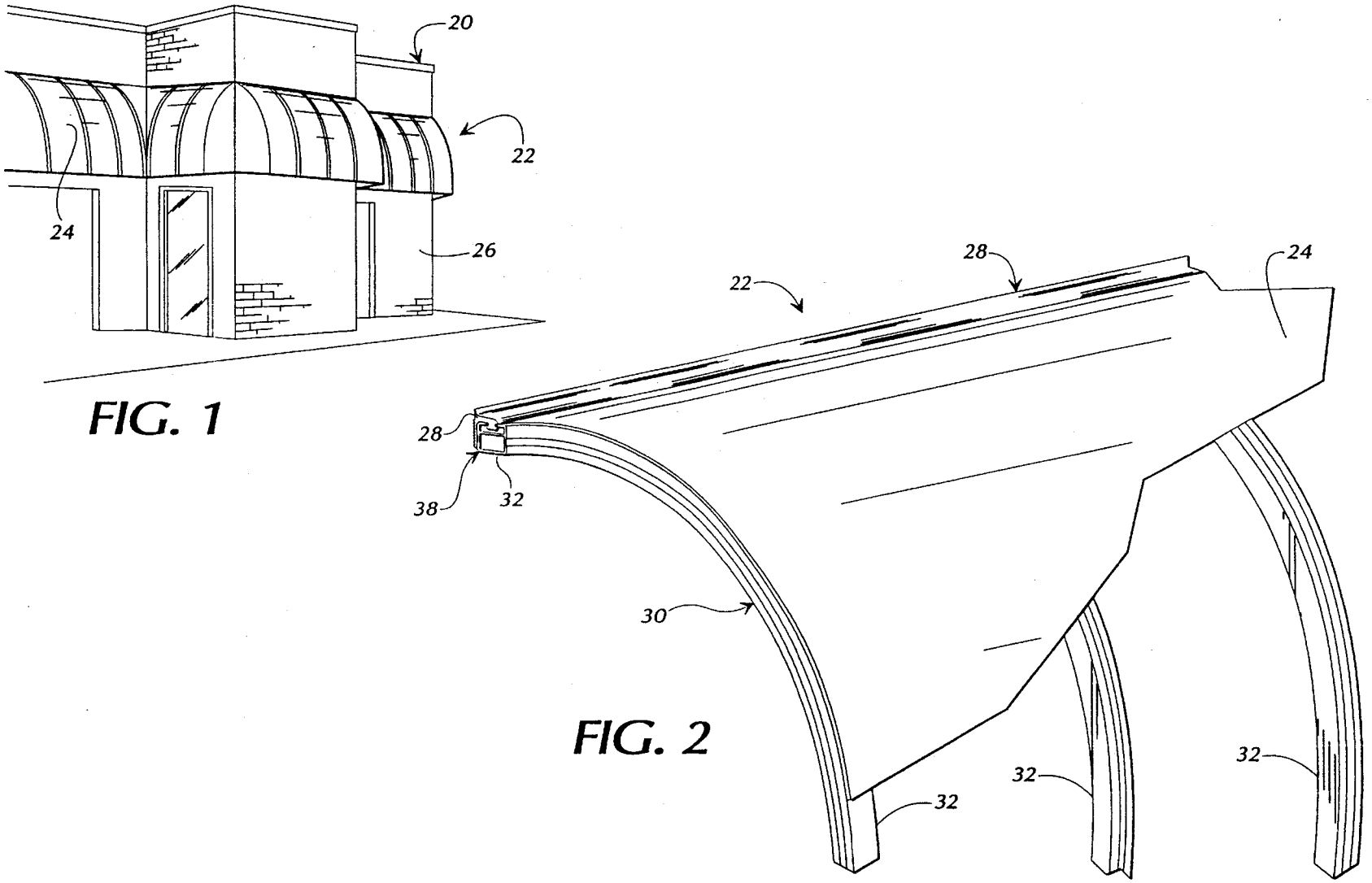
FIG. 1 is a perspective view of a building with an awning assembly attached thereto.
FIG. 2 is an enlarged, isolated, cut-away, perspective view of the left end of a section of the awning assembly of FIG. 1, wherein a flash strip is shown incorporated into the awning assembly in accordance with the preferred embodiment of the present invention.
Figure 3:
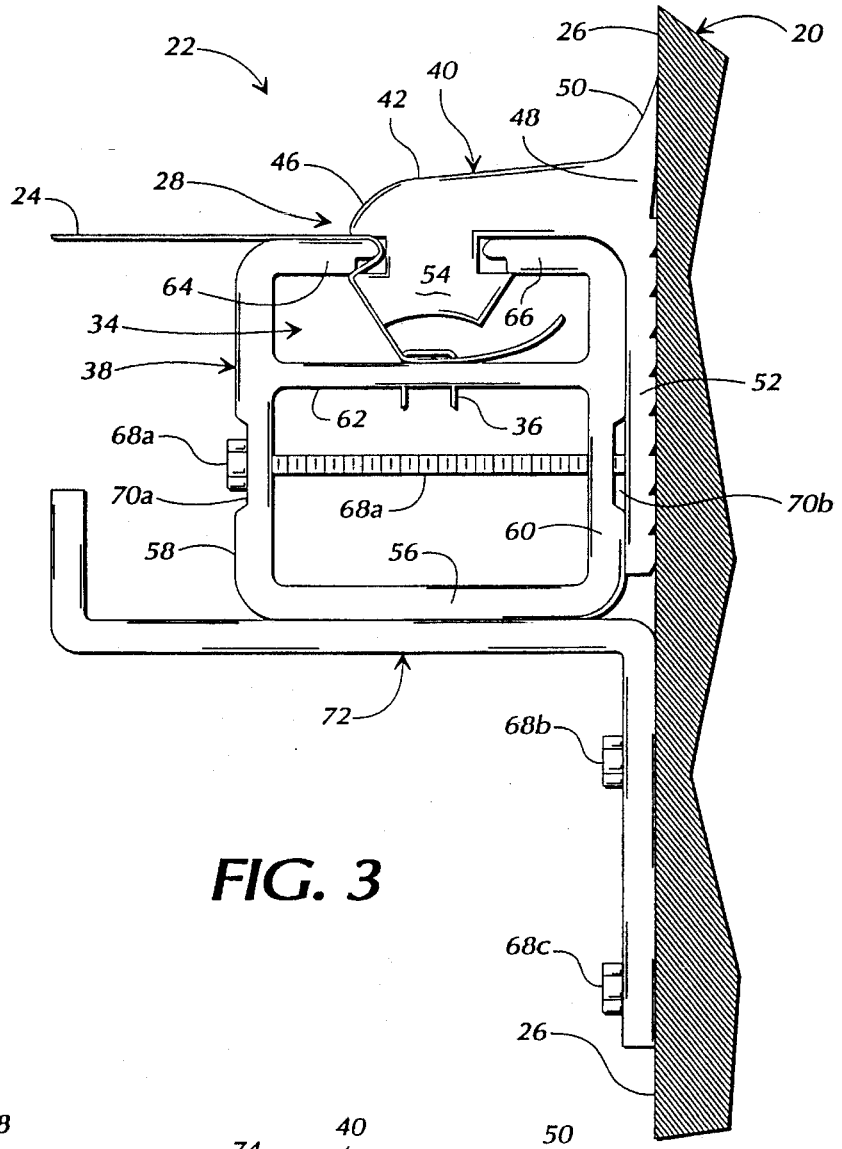
FIG. 3 is a cut-away, right end elevational view of a section of an awning assembly that includes the flash strip and is mounted to a building, in accordance with the preferred embodiment of the present invention.

Referring now in greater detail to the drawings, in which like numerals represent like components throughout the several views, FIG. 1 is a perspective view of a building 20 with an awning assembly 22 attached thereto. In accordance with the preferred embodiment of the present invention, the awning assembly 22 includes a fabric cover 24 and is connected to a wall 26 of the building 20. FIG. 2 is an isolated, cut-away, perspective view of the left end of a section of the awning assembly 22 of FIG. 1, showing a flash strip 28 which is central to the invention of the preferred embodiment. In accordance with the preferred embodiment of the present invention, the awning assembly 22 includes an awning fame 30 to which the cover 24 and the flash strip 28 are attached. The frame 30 is preferably constructed from a plurality of frame tubes 32 that are connected. In accordance with the preferred embodiment of the present invention, each of the frame tubes 32 define an elongated stapling channel 34 (FIGS. 3 and 12)into which portions of the cover 24 are attached by staples 36 (FIG. 3 ). One of the frame tubes 32 is referred to as an anchor tube 38. The anchor tube 38 is typically oriented at the upper edge of the awning assembly 22 and is attached to the wall 26 (FIGS. 1 and 3) of the building 20 (FIGS. 1 and 3 ). In accordance with the preferred embodiment of the present invention, the cover 24 and the flash strip 28 are connected into the stapling channel 34 that is defined by the anchor tube 38.

FIG. 3 is a cut-away, right end elevational view of a section of the awning assembly 22 connected to the wall 26 of the building 20 in accordance with the preferred embodiment of the present invention. As shown in FIG. 3, the flash strip 28 is connected to the anchor tube 38 and is partially sandwiched between the anchor tube 38 and the wall 26. In accordance with the preferred embodiment of the present invention, the flash strip 28 includes an elongated body 40 that includes a top 42, a bottom 44 (FIG. 4), a front end 46, and a rear end 48. A lip 50 preferably protrudes from the rear end 48. A leg 52 preferably protrudes and depends from the rear end 48. And a tab member 54 preferably protrudes and depends from the bottom 44, intermediate the front end 46 and the rear end 48. In accordance with the preferred embodiment of the present invention, the anchor tube 38 includes a base member 56, and a forward upright member 58 and a rearward upright member 60 extending upward from the base member 56. A traversing member 62 preferably spans between the midsections of the upright members 58,60, and oppositely oriented teeth members 64,66 preferably extend toward one another from the tops of the upright members 58,60 to define and partially enclose a stapling channel 34. In accordance with the preferred embodiment of the present invention, the tab member 54 is constructed and arranged to insert into and become removably locked into the stapling channel 34, and the tab member 54 is shown connected into the stapling channel 34 in FIG. 3.

As is also shown in FIG. 3, the anchor tube 38 is connected to the wall 26 by screws 68*a* (only one of which is shown) that extend through the upright members 58,60 and into the wall 26, whereby the awning assembly 22 (FIGS. 1 and 2) is fastened to the wall 26. The upright members 58,60 preferably include indentures 70*a,b* through which the screw 68*a* passes. In accordance with the preferred embodiment of the present invention, the anchor tube 38 rests upon a bracket 72 that is secured to the wall 26 by screws 68*b,c*, and an edge of the fabric cover 24 is fastened into the stapling channel 34 of the anchor tube 38. The fastening of the fabric cover 24 is preferably facilitated by staples 36 (only one of which is shown). As discussed in greater detail below, in accordance the preferred embodiment of the present invention, when the anchor tube 38 is secured to the wall 26 such that the awning assembly 22 is secured to the wall 26, the flash strip 28 is partially sandwiched between and cooperates with the wall 26 and the anchor tube 38 to provide a substantially watertight seal between the wall 36 and the awning assembly 22. As shown in FIG. 3, when the anchor tube 38 is secured to the wall, the tab member 54 preferably extends into the stapling channel 34, the leg 52 is preferably sandwiched between the anchor tube 38 and the wall 26, and the lip 50 preferably extends upward and engages the wall 36 such that any water running down the wall 36 will be diverted by the flash strip 28 onto the fabric cover 24 where the water will flow harmlessly away.

Figure 4:
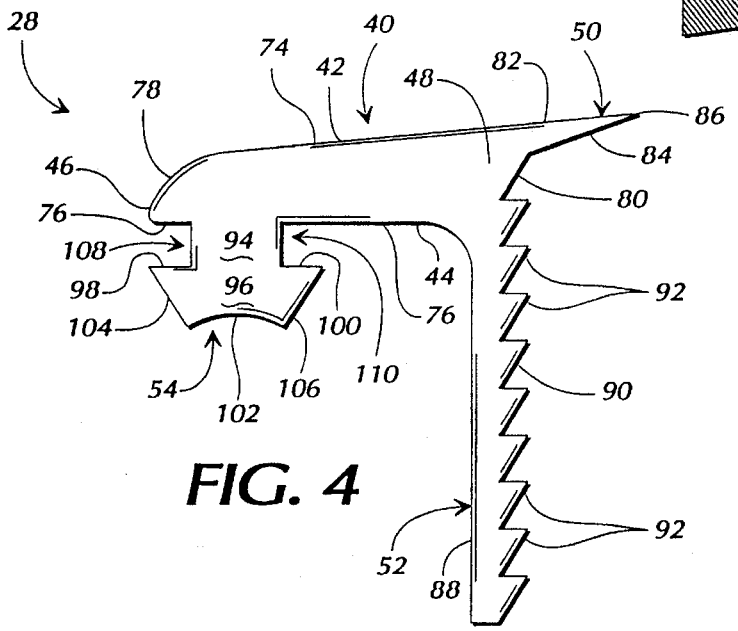
FIG. 4 is an isolated, right end elevational view of the flash strip in accordance with the preferred embodiment of the present invention.

FIG. 4 is an isolated, right end elevational view of the flash strip 28 in accordance with the preferred embodiment of the present invention. Note that in FIG. 4 the lip 50 is in a relaxed configuration. In the relaxed configuration the lip 50 is oriented rearward and slightly upward relative to the elongated body 40. The lip 50 is preferably biased toward the relaxed configuration. Referring momentarily back to FIG. 3, the lip 50 is shown in FIG. 3 in an engaged configuration in which the lip 50 is deformed by and engaging the wall 26 (FIGS. 1 and 3) in a manner that provides a substantially watertight seal therebetween. The biased nature of the lip 50 functions to promote the water-tight seal between the lip 50 and the wall 26.

As shown in FIG. 4, in accordance with the preferred embodiment of the present invention, the top 42 of the elongated body 40 defines a slightly upward sloping top surface 74, the bottom 44 of the elongated body 40 defines a laterally extending bottom surface 76, the front end 46 of the elongated body 40 defines a rounded from surface 78, and the rear end 48 of the elongated body 40 defines a rear surface 80. The lip 50 preferably defines a lip top surface 82 and a lip bottom surface 84 that extend from the top surface 74 and rear surface 80, respectively, in a converging manner to define a tip 86. The leg 52 preferably depends from the rear end 48 of the elongated body 40 and defines a forward surface 88 and an gripping surface 90 opposite from the forward surface 88. The gripping surface 90 preferably defines an uneven surface that will function to help preclude movement of the leg 52 relative to the wall 26 (FIGS. 1 and 3) when the anchor tube 38 (FIGS. 2 and 3) is drawn and secured to the wall 26. In accordance with the preferred embodiment of the present invention, the gripping surface 90 is saw-toothed and includes a plurality of laterally extending ridges 92, only several of which are specifically identified in FIG. 4 in an effort to clarify the view. The tab member 54 preferably depends from the bottom 44 of the elongated body 40 intermediate of the front end 46 and rear end 48, but closer to the front end 46. In accordance with the preferred embodiment, the tab member 54 includes a neck 94 extending from the bottom surface 76 and a cross-member 96 connected to the neck 94 opposite from the bottom surface 76. The cross-member 96 preferably defines shoulder surfaces 98,100, an outwardly facing concave surface 102, and sloping surfaces 104, 106. Tooth receiving channels 108, 110 are defined between the shoulder surfaces 98,100 and the bottom surface 76 of the elongated body 40. The receiving channels 108,110 function to receive the tooth members 64,66 (FIG. 3) of the anchor tube 38 (FIG. 3) when the tab member 54 is inserted into the stapling channel 34 (FIG. 3) of the anchor tube 38.

Figure 5:
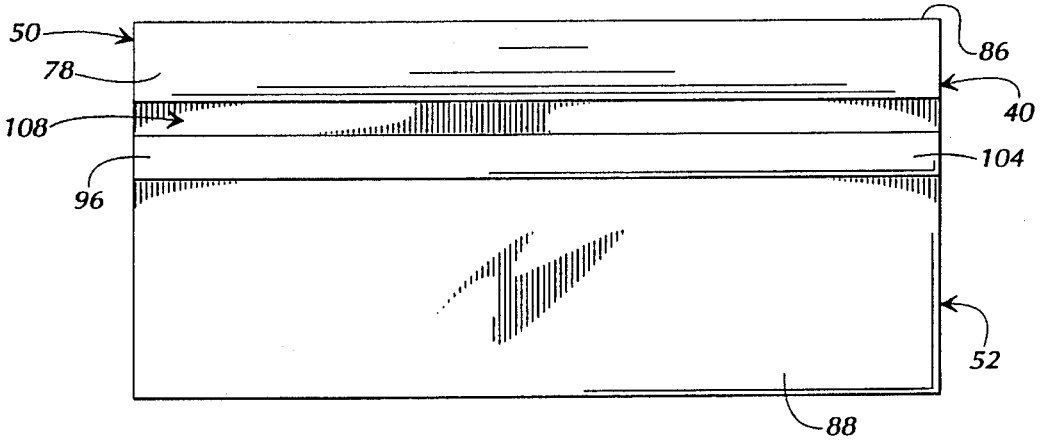
FIG. 5 is an isolated, front elevational view of an elongated segment of the flash strip in accordance with the preferred embodiment of the present invention.
Figure 6:
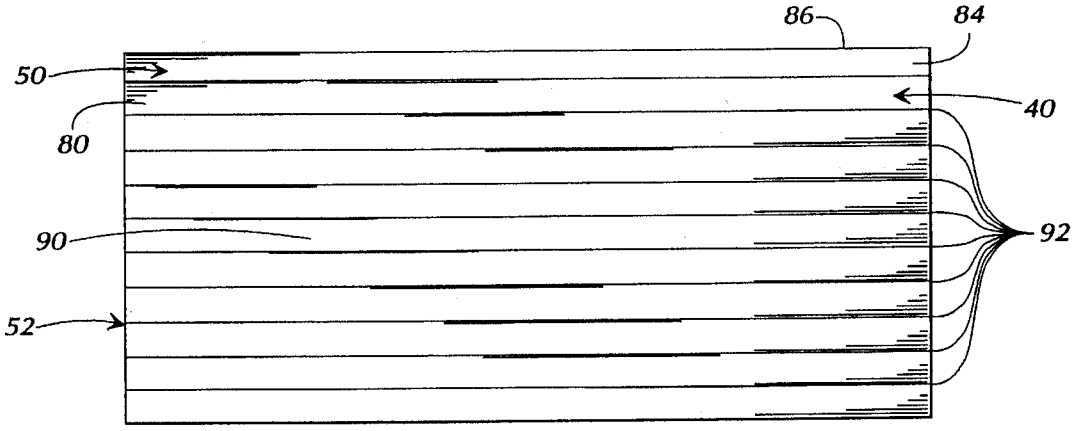
FIG. 6 is an isolated, rear elevational view of an elongated segment of the flash strip in accordance with the preferred embodiment of the present invention.
Figure 7:
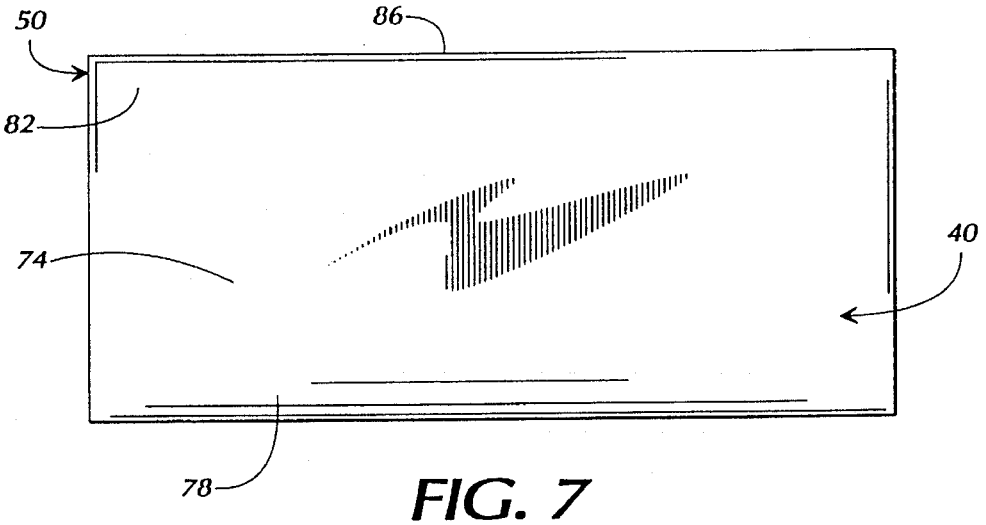
FIG. 7 is an isolated, top plan view of an elongated segment of the flash strip in accordance with the preferred embodiment of the present invention.
Figure 8:
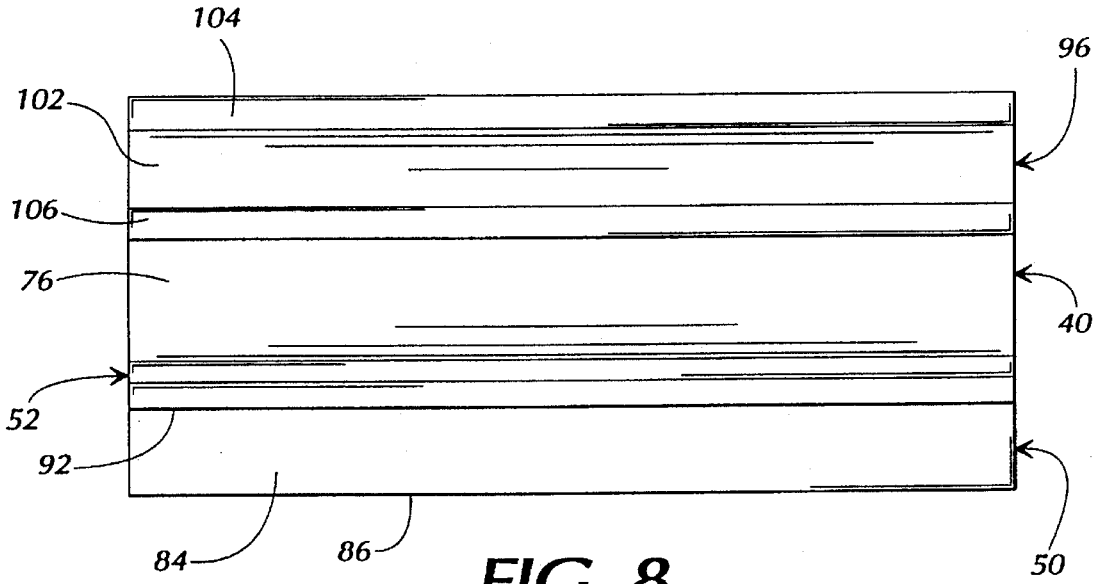
FIG. 8 is an isolated, bottom plan view of an elongated segment of the flash strip in accordance with the preferred embodiment of the present invention.

FIG. 5 is an isolated, front elevational view of an elongated segment of the flash strip 28 in accordance with the preferred embodiment of the present invention. While FIGS. 5–8 show only a segment of flash strip 28, it should be noted that, where possible, long continuous strips of flash strip 28 are employed in awning assemblies 22 (FIGS. 1 and 3 ). Seen in FIG. 5, for example, is the tip 86 of the lip 50, the front surface 78 of the elongated body 40, tooth receiving channel 108, sloping surface 104 of the cross-member 96, and the forward surface 88 of the leg 52. FIG. 6 is an isolated, rear elevational view of an elongated segment of the flash strip 28 in accordance with the preferred embodiment of the present invention. Seen in FIG. 6, for example, is the tip 86 and bottom surface 84 of the lip 50, the rear surface 80 of the elongated body 40, and the gripping surface 90 with its ridges 92. FIG. 7 is an isolated, top plan view of an elongated segment of the flash strip 28 in accordance with the preferred embodiment of the present invention. Seen in FIG. 7, for example, is the top surface 82 and tip 86 of the lip 50, and the top surface 74 and front surface 78 of the elongated body 40. FIG. 8 is an isolated, bottom plan view of an elongated segment of the flash strip 28 in accordance with the preferred embodiment of the present invention. Seen in FIG. 8, for example, is the concave surface 102 and sloping surfaces 104,106 of the cross-member 96, the bottom surface 76 of the elongated body 40, a ridge 92 of the leg 52, and the bottom surface 84 and tip 86 of the lip 50.

Figure 9:
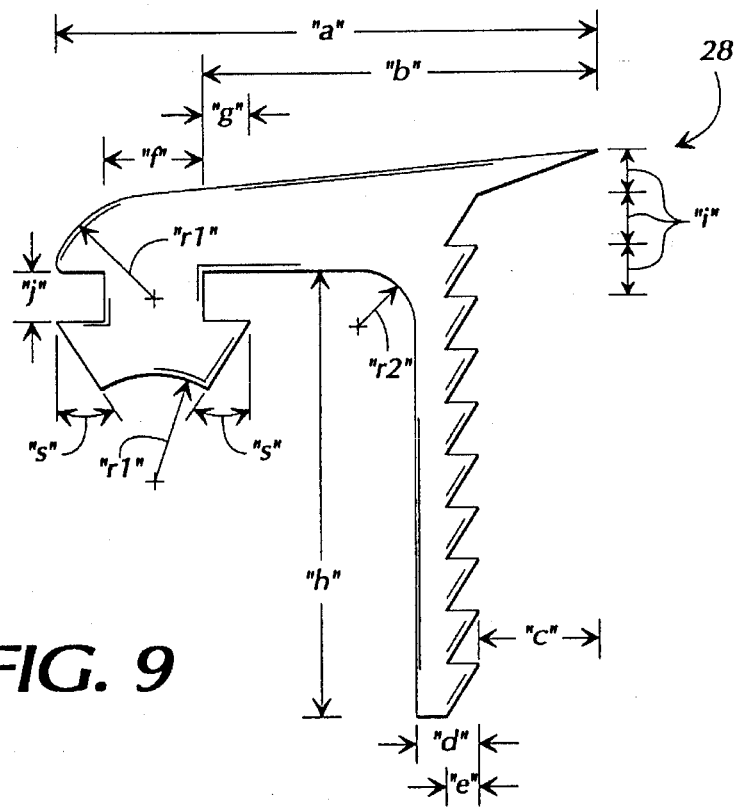
FIG. 9 is another isolated, right end elevational view of the flash strip in accordance with the preferred embodiment of the present invention.

FIG. 9 is another isolated, fight end elevational view of a the flash strip 28 in accordance with the preferred embodiment of the present invention. The flash strip 28 of the preferred embodiment is inventively constructed and arranged to complement and cooperate with the shape and configuration of the anchor tube 38. Referring additionally to FIG. 4, when the flash strip 28 is in the relaxed configuration, a horizontal distance "a" is defined between the forward most portion of the front end 46 of the elongated body 40 and the tip 86 of the lip 50. A horizontal distance "b" is defined between the rearward most portion of the neck 94 and the tip 86 of the lip 50. A horizontal distance "c" is defined between the rearward most portion of a ridge 92 and the tip 86 of the lip 50. A horizontal distance "d" is defined between the forward surface 88 of the leg 52 and the rearward most portion of a ridge 92. A horizontal distance "e" is defined between the forward most portion of a valley defined between ridges 92 and the rearward most portion of a ridge 92. A distance "f" is defined between the forward most surface of the neck 94 and the rearward most surface of the neck 94. A distance "g" is defined between the rearward most surface of the neck 94 and the rearward most portion of the cross-member 96. The distance "g" corresponds to the horizontal depth of tooth receiving channel 110. The distance "g" also corresponds to the distance between the forward most surface of the neck 94 and the forward most portion of the cross-member 96, and thus the horizontal depth of tooth receiving channel 108. A distance "h" is defined between the bottom surface 76 of the elongated body 40 and the bottom most portion of the leg 52. A vertical distance "i" is defined between the tip 86 of the lip 50 and the upper most portion of the rear surface 80 of the elongated body 40. The distance "i" also corresponds to the vertical distance between the upper most portion and the lower most portion of the rear surface 80, and the distance between the peaks of adjacent ridges 92. The distance "i" further corresponds to the vertical distance between the tip 86 of the lip 50 and the upper most portion of the front surface 78 of the elongated body 40. The vertical distance "j" is defined between the bottom surface 76 of the elongated body 40 and the shoulder surfaces 98,100. The sloping surfaces 104, 106 define angles "s" with respect to a vertical reference. The concave surface 102 and the front surface 78 of the elongated body 40 define a radius of curvature "r1" The transitional surface that provides a smooth transition between the bottom surface 76 of the elongated body 40 and the forward surface 88 of the leg 52 defines a radius of curvature "r2".

Figure 10:
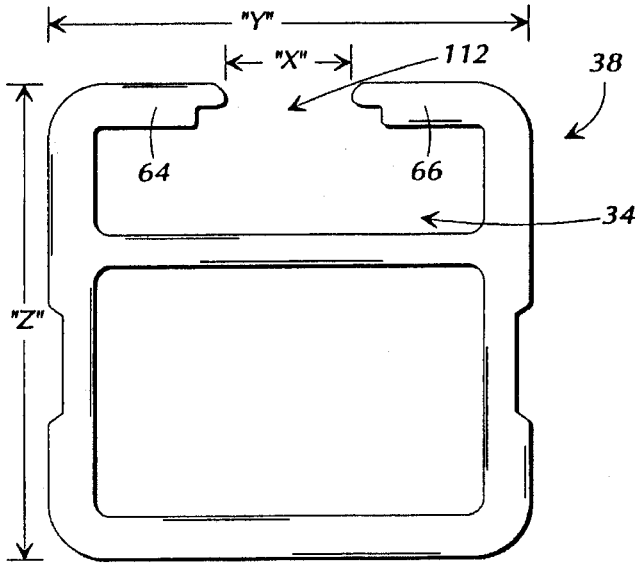
FIG. 10 PRIOR ART
FIG. 10 is an isolated, end elevational view of a framing member to which the flash strip attaches in accordance with the preferred embodiment of the present invention.
Figure 11:
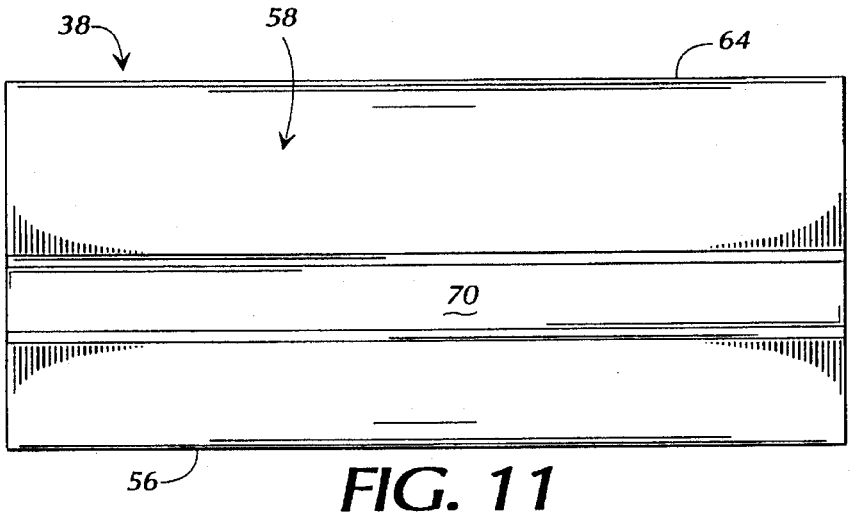
FIG. 11 PRIOR ART
FIG. 11 is an isolated, front elevational view of an elongated segment of the framing member in accordance with the preferred embodiment of the present invention.
Figure 12:
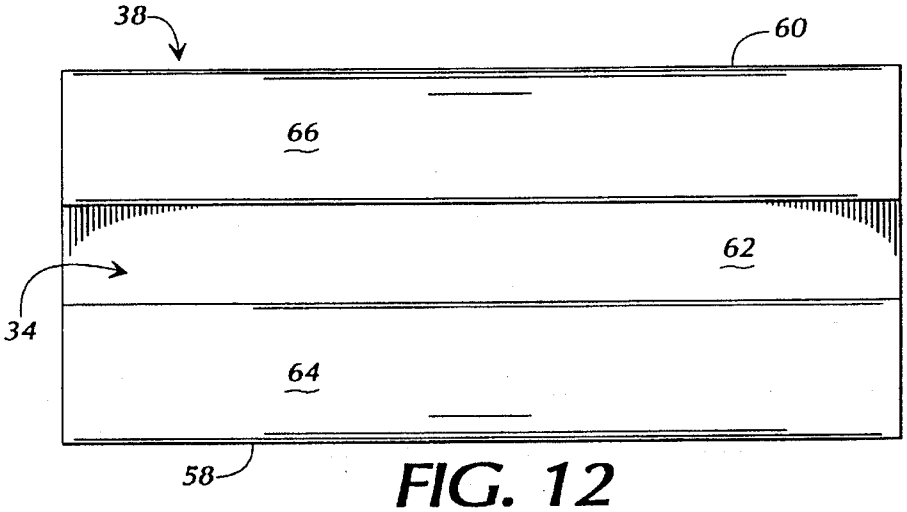
FIG. 12 PRIOR ART
FIG. 12 is an isolated, top plan view of an elongated segment of the framing member in accordance with the preferred embodiment of the present invention.

FIG. 10 is an isolated, right end elevational view of an anchor tube 38 in accordance with the preferred embodiment of the present invention. The anchor tube 38 and its use (without a flash strip 28)in an awning assembly 22 are prior art. However, the interaction and cooperation between the flash strip 28 (FIGS. 2–9) and the anchor tube 38 is an integral and important part of the present invention. In accordance with the preferred embodiment of the present invention, the anchor tube 38 defines a height "z" and a width "y", and the teeth members 64,66 define a gap 112 therebetween that provides access to the stapling channel 34 and defines a width "x". FIG. 11 is an isolated, front elevational view of an elongated segment of the anchor tube 38 in accordance with the preferred embodiment of the present invention. A rear elevational view of an elongated segment of the anchor tube 38 would be, in accordance with the preferred embodiment, identical to FIG. 11. FIG. 12 is an isolated, top plan view of an elongated segment of the anchor tube 38 in accordance with the preferred embodiment of the present invention.

Referring back to FIGS. 1 and 2, as discussed above, in accordance with the preferred embodiment of the present invention, the flash strip 28 is employed between an awning assembly 22 and the wall 26 of a building 20 to establish a substantially watertight seal therebetween. Following is a discussion of an acceptable manner in which an awning assembly 22 is constructed and attached to a wall 26 with the flash strip 28 disposed acceptably therebetween, in accordance with the preferred embodiment of the present invention. Initially, the awning assembly 22 is constructed and the flash strip 28 is attached thereto. The awning frame 30 is constructed such that an anchor tube 38 is oriented at the upper most portion of the awning frame 30 were the awning frame 30 will be attached to the wall 26. Referring additionally to FIG. 3, the anchor tube 38 is incorporated into the awning frame 30 such that it is configured with the gap 112 (FIG. 10) that provides access to the stapling channel 34 oriented upward so that the anchor tube 38 will eventually be configured as shown in FIG. 3 when secured to the wall 26. Once the frame 30 is constructed, the frame 30 is covered with the fabric cover 24 which is preferably stapled into the stapling channels 34 of the frame tubes 32. The flash strip 28 is oriented relative to the anchor tube 38 so that the leg 52 of the flash strip 28 will be sandwiched between the anchor tube 38 and the wall 26 when the anchor tube 38 is secured to the wall 26. The flash strip 28 is then mated to the anchor tube 38 by forcing the tab member 54 into the stapling channel 34, whereby the teeth members 64,66 reside in the tooth receiving channels 108, 110, respectively. The insertion of the tab member 54 into the stapling channel 34 functions to increase the tautness of the fabric cover 24. In accordance with the preferred embodiment of the present invention, once the flash strip 28 is properly mated to the anchor tube 38, the leg 52 of the flash strip 28 is attached by small screws (not shown) to the anchor tube 38 in an effort to ensure that the flash strip 28 is securely engaged to the anchor tube 38. The small screws are screwed into the leg 52 of the flash strip 28 from the side of the leg 52 that defines the gripping surface 90 (FIG. 4). The small screws are oriented such that they thread through the rearward upright member 60 of the anchor tube 38 at indenture **70*b*. Furthermore, the small screws are sized and positioned, and the flash strip 28 is constructed so that the heads of the small screws deform into the leg 52 of the flash strip 28 and reside in indenture 70*b*, whereby the heads of the small screws do not interfere with the substantially watertight attachment between the awning assembly 22 and the wall 26**.

Referring further to FIG. 3, once the awning assembly 22 is constructed and the flash strip 28 is secured along the entire length of the anchor tube 38, a small bead of caulk is preferably placed along the rear surface 80 (FIG. 4) of the elongated body 40 of the flash strip 28. The awning assembly 22 is then hoisted and suspended in near final position by allowing the anchor tube 38 to rest upon a plurality of brackets 72 (only one of which is shown). The anchor tube 38 is then attached to the wall 26 by applying, for example, screws **68*a* (only one of which is shown) through the anchor tube 38 and into the wall 26. As the anchor tube 38 is drawn toward the wall, the leg 52 of the flash strip 28 is securely sandwiched between the anchor tube 38 and the wall 26. Any movement of the leg 52 up or down the wall is minimized due to the gripping action of the gripping surface 90 (FIG. 4) and the small screws (not shown but previously discussed) that secure the leg 52 to the anchor tube 38. As the lip 50 engages the wall 26 it deforms such that the tip 86 (FIG. 4) and lip bottom surface 84 (FIG. 4) securely engage and slide up the wall 26 to become oriented as shown in FIG. 3, whereby a substantially watertight seal is defined between the flash strip and the wall 26. Once the awning assembly is attached to the wall 26, an extra dab of caulking is preferably applied to the flash strip 28, from below, at any vertical seams in the wall 26**.

In accordance with the preferred embodiment of the present invention, the flash strip 28 is preferably formed from a single extruded piece of a suitable plastic material, such as, for example, polyvinyl chloride. For aesthetic purposes, the flash strip 28 is often made to be the same color as the fabric cover 24 that it will be used with. In accordance with the preferred embodiment of the present invention, the anchor tube 38 is acceptably constructed of metal, and is preferably extruded from aluminum. Acceptable anchor tubes 38 are commercially available from, for example, Steel Stitch Corporation of Kennessaw, Ga., where they are identified by part numbers SSM-1-A, SSM-1-B, SSM-1-C, and SSM-1-A, SSM-1-17.

As discussed above, the flash strip 28 is inventively sized and arranged to interact with an anchor tube 38. Referring back to FIG. 10 and the discussion thereof above, the following are examples of acceptable dimensions of an acceptable anchor tube 38, in accordance with the preferred embodiment of the preferred embodiment. The height "z" and width "y" are both acceptably 1.0 inch, and the width "x" of the gap 112 is acceptably 0.375 inches. Referring back to FIG. 9 and the discussion thereof, the following are examples of acceptable dimensions for a flash strip 28 that would be used in combination with an anchor tube 38 having the above-specified dimensions, in accordance with the preferred embodiment of the present invention. For such a flash strip 28, the horizontal distance "a" is acceptably 1.051 inches. The horizontal distance "b" is acceptably 0.400 inches. The horizontal distance "c" is acceptably 0.375 inches. The horizontal distance "d" is acceptably 0.120 inches. The horizontal distance "e" is acceptably 0.06 inches. The distance "f" is acceptably 0.186 inches. The distance "g" is acceptably 0.095 inches. The distance "h" is acceptably 0.847 inches. The vertical distance "i" is acceptably 0.100 inch. The distance "j" is acceptably 0.093 inches. The angles "s" are acceptably 30°. The radius of curvature "r1" is acceptably 0.200 inches. And the radius of curvature "r2" is acceptably 0.125 inches. In accordance with the preferred embodiment of the present invention, an example of an acceptable tolerance for the above dimensions is plus or minus 10%. In accordance with alternate embodiments of the present invention, flash strips 28 are used in combination with variously sized anchor tubes 38. In such situations, the dimensions of the flash strips 28 preferably vary proportionately with respect to the dimensions of the anchor tubes 38. While proportional variation is preferred, it is also within the scope of the present invention to provide a flash strip 28 having dimensions that do not vary proportionally with the dimensions of an anchor tube 38, so long as the flash strip 28 performs the intended function.

While the embodiments of the present invention which have been disclosed herein are the preferred forms, other embodiments of the method and apparatus of the present invention will suggest themselves to persons skilled in the art in view of this disclosure. Therefore, it will be understood that variations and modifications can be effected within the spirit and scope of the invention and that the scope of the present invention should only be limited by the claims below. It is also understood that any relative dimensions and relationships shown on the drawings are given as the preferred relative dimensions and relationships, but the scope of the invention is not to be limited thereby.

I claim:

1. A flexible, water-impervious sealing strip for forming a seal between a frame member of an awning assembly and a building structure to which the awning assembly is attached, the sealing strip comprising:

an elongated central body including a top, a bottom, a rear end, and a front end opposite from said rear end;

a first protrusion extending upwardly and rearwardly from said rear end for engaging the building structure to which the awning assembly is attached; and a second protrusion depending from said bottom of said central body for being retained by the awning assembly, wherein said second protrusion is a tab member constructed and arranged to be retained by a frame member of the awning assembly, and wherein said tab member includes, a neck extending from said bottom of said central body at a position intermediate of said rear end and said front end of said central body, and a cross-member attached to and extending transverse to said neck at a position distal from said central body, wherein said cross-member extends farther toward said front end and said rear end of said central body than does said neck.

2. The sealing strip of claim 1, wherein said neck is closer to said front end than said rear end.

3. A flexible, water-impervious sealing strip for forming a seal between a frame member of an awning assembly and a building structure to which the awning assembly is attached, the sealing strip comprising:

an elongated central body including a top, a bottom, a rear end, and a front end opposite from said rear end;

a first protrusion extending upwardly and rearwardly from said rear end for engaging the building structure to which the awning assembly is attached, wherein said first protrusion is a lip defining a lip lower surface and a lip upper surface that extend from said central body in a converging manner to define a tip positioned distal from said central body, wherein said lip upper surface slopes generally downward in the direction from said tip toward said rear end of said central body, wherein said top of said central body defines a body top surface that is an extension of said lip upper surface, wherein said front end of said central body defines a body front surface that is an extension of said body top surface, and wherein said sealing strip is so constructed and arranged that said lip upper surface, said body top surface, and said body front surface cooperate to define a continuous, generally downward sloping surface capable of diverting water from said tip across said central body; and a second protrusion depending from said bottom of said central body for being retained by the awning assembly.

4. The sealing strip of claim 3, wherein said second protrusion is a tab member constructed and arranged to be retained by a frame member of the awning assembly and including, at least, a neck extending from said bottom of said central body at a position intermediate of said rear end and said front end of said central body, and a cross-member attached to and extending transverse to said neck at a position distal from said central body, wherein said cross-member extends farther toward said front end and said rear end of said central body than does said neck, and wherein said cross-member defines a downwardly facing concave surface positioned distally from said central body.

5. The sealing strip of claim 3, further comprising an elongated leg member depending from said rear end of said central body.

6. The sealing strip of claim 5, wherein said leg member extends farther from said central body than said tab member.

7. The sealing strip of claim 5, wherein said leg member is for sandwiching between the building structure and the frame member, wherein said leg member defines a first surface facing said tab member for engaging the frame member, and wherein said leg member defines an uneven gripping surface opposite from said first surface for engaging the building structure.

8. The sealing strip of claim 7, wherein said gripping surface is a saw-toothed surface that defines a plurality of elongated ridges.

9. A flexible, water-impervious sealing strip for forming a seal between a frame member of an awning assembly and a building structure to which the awning assembly is attached, the sealing strip comprising:

an elongated central body including a top, a bottom, a rear end, and a front end opposite from said rear end;

a first protrusion extending upwardly and rearwardly from said rear end for engaging the building structure to which the awning assembly is attached;

a second protrusion depending from said bottom of said central body for being retained by the awning assembly; and a third protrusion, wherein said third protrusion depends from said rear end of said central body, and wherein said first protrusion and said third protrusion extend from said central body in a divergent manner.

10. The sealing strip of claim 9, wherein said first protrusion is a lip, wherein said second protrusion is a tab member, and wherein said third protrusion is an elongated leg member.

11. The sealing strip of claim 10, wherein said lip defines a lip lower surface and a lip upper surface that extend from said central body in a converging manner to define a tip positioned distal from said central body.

12. The sealing strip of claim 11, wherein said tab member is constructed and arranged to be retained by a frame member of the awning assembly and includes, at least, a neck extending from said bottom of said central body at a position intermediate of said rear end and said front end of said central body, and a cross-member attached to and extending transverse to said neck at a position distal from said central body.

13. The sealing strip of claim 12, wherein said leg member is for sandwiching between the building structure and the frame member, wherein said leg member defines a first surface facing said tab member for engaging the frame member, and wherein said leg member defines an uneven gripping surface opposite from said first surface for engaging the building structure.

14. The sealing strip of claim 13, wherein said central body defines, at least, a body top surface that extends generally laterally, a body bottom surface that extends generally laterally, a body rear end surface that extends generally horizontally, and a body front end surface that slopes downward from said body top surface to said body bottom surface, wherein said lip upper surface extends generally upward from said body top surface, and wherein the sealing strip is so constructed and arranged that said lip upper surface, said body top surface, and said body from end surface cooperate to define a surface capable of directing a flow of moisture from said tip toward and across said body top surface, and then toward and across said body front end surface, wherein said lip lower surface extends generally upward and rearward from said body rear end surface, wherein said leg first surface extends downward from said body bottom surface, and wherein said leg second surface extends downward from said body rear end surface.

15. An awning sub-structure for attachment to a building structure, the awning sub-structure comprising:

an elongated framing tube constructed and arranged for attachment to the building structure, said framing tube defining an elongated top side, an elongated rear side, and an elongated channel accessible along the length of said elongated top side of said framing tube; and an elongated, flexible, water-impervious sealing strip for forming a seal between said framing tube and the building structure, said sealing strip including, at least, an elongated central body including, at least, a top, a bottom engaging said top side of said framing tube, a rear end, and a front end opposite from said rear end, a first protrusion extending upwardly and rearwardly from said rear end, wherein said first protrusion is constructed and arranged to engage the building structure and divert water away from the building structure, and a second protrusion depending from said bottom of said central body and retained within said channel, wherein said second protrusion and said channel are constructed and arranged to cooperate so as secure said sealing strip to said framing tube.

16. The awning sub-structure of claim 15, wherein said first protrusion is a lip defining a lip lower surface and a lip upper surface that extend from said central body in a converging manner to define a tip positioned distal from said central body, wherein said sealing strip further comprises a third protrusion that is an elongated leg member depending from said rear end of said central body and engaging said rear side of said framing tube, wherein said leg member is constructed and arranged to sandwich between said framing tube and the building structure when said framing tube is attached to the building structure, wherein said lip upper surface slopes generally downward in the direction from said tip toward said rear end of said central body, wherein said top of said central body defines a body top surface that is an extension of said lip upper surface, wherein said front end of said central body defines a body front surface, wherein said sealing strip is constructed and arranged so that said tip, said lip upper surface, said body top surface, and said body from surface cooperate to define a continuous, generally downward sloping surface for diverting water away from the building structure to which the awning is attached.

17. The awning sub-structure of claim 16, further comprising a fabric cover extending into said channel and connected therein to said flaming tube.

18. The awning sub-structure of claim 17, wherein said second protrusion is a tab member including, at least, a neck extending from said bottom of said central body at a position intermediate of said rear end and said front end of said central body, and a cross-member attached to and extending transverse to said neck at a position distal from said central body, wherein said cross-member extends farther toward said front end and said rear end of said central body than does said neck to define a forward tooth receiving channel and a rearward tooth receiving channel between said cross-member and said bottom of said central body, and wherein said flaming tube includes, at least, oppositely oriented teeth members that extend into said tooth receiving channels to secure said sealing strip to said framing tube.

19. A structure for providing shelter from weather, the structure comprising:

a building including a wall;

an awning attached to said wall and including, at least, a plurality of framing tubes, wherein each flaming tube of said plurality of framing tubes defines a top side and a channel accessible along the length of said top side, and wherein a framing tube of said plurality of flaming tubes is an anchor tube that is connected to said wall and further defines a rear side facing said wall, and a fabric cover extending between and connected into said channels; and a flexible, water-impervious sealing strip interconnected with and providing a seal between said wall and said anchor tube, wherein said sealing strip includes, at least, an elongated central body including, at least, a top, a bottom, a rear end facing said wall, and a from end opposite from said rear end and said wall, wherein said bottom engages said top side of said anchor tube and covers said channel of said anchor tube, a lip extending upwardly and rearwardly from said rear end and engaging said wall, wherein said lip defines a lip lower surface and a lip upper surface that extend from said central body, and a protrusion depending from said bottom of said central body and extending into, and restrained within, said channel of said anchor tube to secure said sealing strip to said anchor tube, wherein said lip upper surface slopes generally downward, wherein said top of said central body defines a body top surface, wherein said front end of said central body defines a body front surface, wherein said sealing strip is constructed and arranged so that said lip upper surface, said body top surface, and said body from surface cooperate to define a continuous, generally downward sloping surface for diverting water from said wall, across said central body, and onto said fabric cover.

20. The structure of claim 19, wherein said lip lower surface and a lip upper surface extend from said central body in a converging manner to define a tip positioned distal from said central body and engaging said wall.

21. The structure of claim 19, wherein said protrusion is a tab member including, at least, a neck extending from said bottom of said central body at a position intermediate of said rear end and said front end of said central body, and a cross-member attached to and extending transverse to said neck at a position distal from said central body, wherein said cross-member extends farther toward said front end and said rear end than does said neck to define a forward tooth receiving channel and a rearward tooth receiving channel between said cross-member and said bottom of said central body, and wherein said anchor tube includes, at least, oppositely oriented teeth members that extend into said tooth receiving channels to secure said sealing strip to said anchor tube.

22. The structure of claim 19, wherein said sealing strip further includes, at least, a leg depending from said rear end of said central body and sandwiched between said anchor tube and said wall, whereby said leg aids in the securing of said sealing strip with respect to said wall and said anchor tube.

* * * * *

UNITED STATES PATENT AND TRADEMARK OFFICE

CERTIFICATE OF CORRECTION

PATENT NO. : 5,469,672

DATED : November 28, 1995

INVENTOR(S) : Larry M. Fisher

It is certified that error appears in the above-identified patent and that said Letters Patent is hereby corrected as shown below:

Col. 12, line 31, claim 19, line 6, by deleting "flaming" and substituting therefor --framing--.

Col. 12, line 34, claim 19, line 9, by deleting "flaming" and substituting therefor --framing--.

Col. 12, line 66, claim 19, line 41, by deleting "from" and substituting therefor --front--.

Signed and Sealed this

Nineteenth Day of March, 1996

Bruce Lehman

*Attest:*

BRUCE LEHMAN

*Attesting Officer*

*Commissioner of Patents and Trademarks*